United States Patent [19]

Heitz

[11] Patent Number: 4,649,893

[45] Date of Patent: Mar. 17, 1987

[54] COMPRESSED-AIR WEAPON WITH PISTON ROD HOOK ELEMENT AND COUNTER-HOOK ENGAGEMENT SYSTEM

[75] Inventor: Walter Heitz, Rastatt, Fed. Rep. of Germany

[73] Assignee: Mayer & Grammelspacher DIANAWERK

[21] Appl. No.: 704,334

[22] Filed: Feb. 22, 1985

[30] Foreign Application Priority Data

Feb. 24, 1984 [DE] Fed. Rep. of Germany ..... 3406757

[51] Int. Cl.[4] ..... F41B 11/00

[52] U.S. Cl. ..... 124/37; 124/40; 124/67

[58] Field of Search ..... 124/31, 37, 38, 40, 124/66, 67, 68, 80

[56] References Cited

U.S. PATENT DOCUMENTS

| | | | |
|---|---|---|---|
| 944,188 | 12/1909 | Heilprin | 124/40 X |
| 1,503,913 | 8/1924 | Miles | 124/67 |
| 3,315,397 | 4/1967 | Gilliam et al. | 124/80 X |
| 3,839,999 | 10/1974 | Fleming et al. | 124/40 X |
| 3,958,549 | 5/1976 | Johansson et al. | 124/67 |

FOREIGN PATENT DOCUMENTS

| | | | |
|---|---|---|---|
| 128429 | 7/1948 | Australia | 124/67 |
| 900427 | 12/1953 | Fed. Rep. of Germany | 124/67 |
| 960614 | 3/1957 | Fed. Rep. of Germany | 124/67 |

*Primary Examiner*—Richard T. Stouffer

*Attorney, Agent, or Firm*—Toren, McGeady and Goldberg

[57] ABSTRACT

In a compressed-air weapon, for the simplification of original production and repair and for the simplification of stockholding it is proposed that the trigger, the counter-hook-engagement system, the trigger return spring and the trigger safety catch system if provided are combined into one prefabricated construction unit which can be united as a whole with the cylinder tube and the stock.

30 Claims, 10 Drawing Figures

COMPRESSED-AIR WEAPON WITH PISTON ROD HOOK ELEMENT AND COUNTER-HOOK ENGAGEMENT SYSTEM

The invention relates to a compressed-air weapon.

Such a compressed-air weapon is known by way of example from Fed. German P.S. No. 900,427.

In the known device the trigger, the parts of the counter-hook-engagement system and the trigger return spring are fitted individually to the cylinder tube. This signifies that in the case of a defect in one of these parts these must be individually detached from the cylinder tube. Therefore as a rule a repair is possible only in the factory, but not in the gun shop.

The invention is based upon the problem of assembling a compressed-air weapon of this classification so that the repair-susceptible parts can be removed from the weapon and reinstalled in a simple manner, so that either they can be replaced in the gun shop or they can be detached from the remainder of the weapon, despatched to the manufacturing works, repaired there and then reinstalled in the weapon by the weapon dealer.

It is a special advantage of the solution according to the invention that the prefabricated construction unit can be kept in stock at the manufacturing works and also by the weapon dealer and in the case of an order for repair it is merely necessary to replace the defective construction unit by a construction unit kept in stock. This proceeds in the simplest manner because the small parts of the counter-hook-engagement system, the trigger return spring and possibly the small parts of the trigger safety catch system do not need to be detached from one another at all, but remain assembled in the construction unit.

It is furthermore a special advantage for the manufacturer and also for the weapon dealer that he can install the construction groups containing the counter-hook-engagement system, the trigger return spring and the trigger safety catch system, if provided, in different weapons, so that it is necessary to keep only one single type, or only a few types, of construction unit in stock, which can then be combined with the different weapons, with the use if necessary of adapter or liner pieces.

Further features of the invention appear in the following description.

The invention is explained by the accompanying Figures, wherein.

Figure 1:
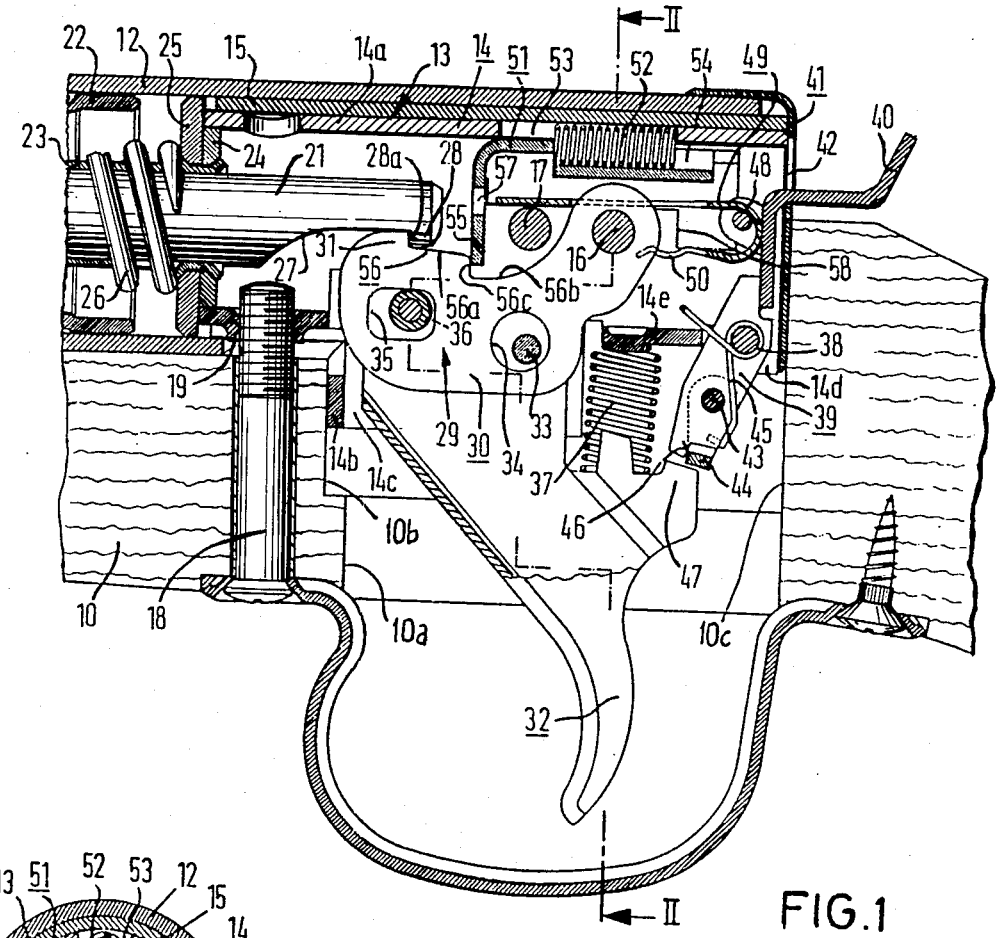
FIG. 1 represents a longitudinal section through the construction unit containing the counter-hook-engagement system, the trigger return spring and the trigger safety catch system, assembled with a cylinder tube and installed in a stock, the weapon being cocked and the safety catch set.
Figure 7:
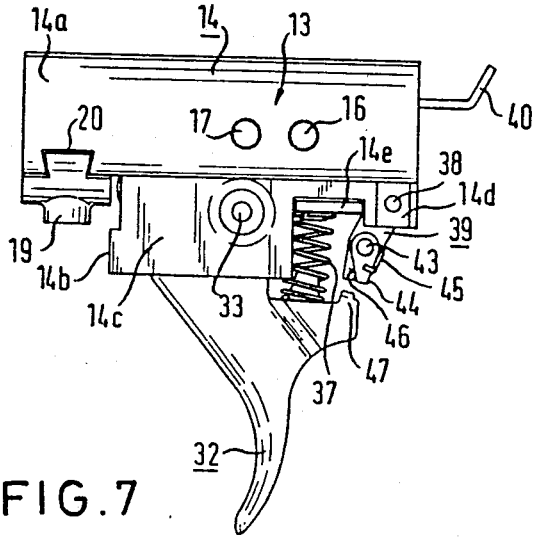
FIG. 7 shows a view of the lock case holding the construction unit together, in the form of embodiment of the construction unit according to FIGS. 1 to 6.

In FIG. 1 the stock of the weapon is designated by 10. An axially extending cylinder tube 12 is secured on the stock. The stock 10 has a recess 10*a* extending vertically with respect to the axis of the cylinder 12. The cylinder tube 12 has a slot 12*a* in its periphery located within the stock recess 10*a*. The manner of securing will be discussed later. A construction unit designated quite generally by 13 is inserted into the cylinder tube 12. This construction unit 13 comprises a lock case 14, which is produced from a one-piece cut-out sheet metal shape and can be seen better from FIG. 7. The lock case 14 comprises a cylindrical lock case part 14*a* and, adjoining this, downwardly extending wall attachments 14*b*, 14*c*, and 14*d*. The cylinder lock case part 14*a* has a cylindrically closed forward section and a partially cylindrical rearward section with an opening 14*b* adjacent the slot 12*a* in the cylinder tube 12. The opening 14*h* has longitudinal edges 14*i* substantially parallel to the cylinder tube axis. Wall attachments 14*c* of the partially cylindrical rearward section extend downwardly from the edges 14*i* and define a lower lock case part 14*c*, 14*b*. The lower lock case part 14*c*, 14*b* passes through the slot 12*a* and are received in the recess 10*a*. The lower lock case part 14*c*, 14*b* engages at least one axially directed end face 10*b*, 10*c* of the recess 10*a*. The cylindrical lock case part is received along its total length in the cylinder tube 12 so that a rearward end of the partially cylindrical rearward section is adjacent the rearward end of the cylinder tube and the cylindrically closed forward section extends forwardly of the recess 10*a*. If indications of direction are given here, such for example as "downwards", the assumption is always to be made that the weapon is set with the barrel in the horizontal direction and the trigger points vertically downwards.

In the case of the example according to FIG. 1 the cylindrical lock case part 14*a* is inserted through an adapter liner sleeve 15 into the cylinder tube 12, different adapter liner sleeves 15 or concentric groups of such adapter liner sleeves 15 being available or formable so that one and the same construction group 13 may be inserted into different cylinder tubes 12. The construction unit 13 is made fast in the cylinder tube 12 by two diametrical pins 16 and 17, in the axial direction of the cylinder tube; the diametrical pins 16 and 17 pass through aligned bores of the cylindrical lock case part 14*a*, the adapter liner sleeve 15 and of the cylinder tube 12. In this way the cylinder tube 12 and the lock case 14 are combined into a rigid assembly unit, which for its part is secured to the stock 10. As may be seen from FIG. 1, a threaded bolt 18 extending through the stock 10 is screwed into a threaded bore 19 of the cylindrically closed forward section of the cylindrical lock case part 14*a* and serves for the securing of this assembly unit. Moreover the cylinder tube 12 is screwed, in a manner not illustrated in FIG. 1, to the stock 10 by two further screws in the region of its forward end. As may be seen from FIG. 7, the cylindrical lock case part 14*a* is closed by a dovetail-type tongue and groove pairing 20, and thus stabilised.

As may be seen from FIG. 1, a piston rod 21 is accommodated in the cylinder tube 12. The piston rod 21 carries at its left end in FIG. 1 a piston (not shown) which together with the left end (likewise not shown) of the cylinder tube 12 forms a compression chamber. From the piston a piston tube united with the piston extends to the right; the right end of this piston tube is recognisable in FIG. 1 and is designated by 22. The piston rod 21 is surrounded by a guide sleeve 23 which is connected by crimping at its right end in FIG. 1 with a centering washer 24 and a piston spring support washer 25. The washer 24 is inserted into the cylindrical lock case part 14*a*. A piston spring 26 bears on the piston spring support washer 25 and presses with its left end (not shown in FIG. 1) against the piston.

At the right end of the piston rod 21 a hook element 28 with a hook engagement face 28*a* is formed by a milled-out portion 27. This hook element 28 can be held back against the action of the compressed piston spring 26 by a counter-hook-engagement system 29 pertaining to the construction unit 13.

The counter-hook-engagement system 29 includes a trigger insert 30 which is mounted pivotably about the diametrical pin 16. The axis of the diametrical pin 16 approximately intersects the axis of the piston rod 21. On the trigger insert 30 there is fitted a counter-hook element 31 which is in hook engagement in FIG. 1 with the hook element 28 in the region of the hook-engagement face 28*a*.

A trigger 32 is mounted pivotably on a bearing bolt 33 between the two parallel wall extensions 14*c* of the lock case 14. The bearing bolt 33 passes through a play-permitting opening 34 of the trigger insert 30, so that the trigger insert 30 is pivotable about the diameterical pin 16.

The trigger insert 30 has a window 35 in which a roll journal 36 seated on the trigger 32 engages with a certain play. A trigger return spring 37 which seeks to pivot the trigger 32 in the clockwise direction about the bearing bolt 33 acts upon the trigger 32. The trigger return spring 37 is supported on a lug 14*e* of the lock case 14. The roll journal 36 bears under the action of the trigger return spring 37 on the upper defining edge of the window 35 of the trigger insert 30. Thus the hook element 28 and the counter-hook element 31 are held in engagement with one another. Therefore the trigger insert 30 transmits the full spring force of the piston spring 26, which lies in the order of magnitude of 80 kp., to the diametrical pin 16. Since the axis of the diametrical pin 16 approximately crosses the axis of the piston rod 21, the hook-engagement face 28*a* lies substantially tangentially in relation to the axis of the diametrical pin 16 and the hook element 28 also lies substantially on the axis of the piston rod 21, the force of the piston spring 26 is taken up without substantial transverse forces in the construction unit.

It is seen that the bearing bolt 33 of the trigger 32 lies substantially in the middle of the length between the diametrical pin 16 and the roll journal 36 and that the roll journal 36 lies substantially vertically beneath the hook-engagement face 28*a*. Furthermore the bearing bolt 33 lies downwardly offset in relation to the piston rod axis 21. This selection of the system points has proved favourable with regard to a secure retention of the cocked piston rod 21 for the one part and to a trigger action with relatively slight shooting force upon the trigger 32 for the other part. This is of essential importance if it is considered that a force of 80 kp. must be transmitted between the hook element 28 and the counter-hook element 21 and that on the other hand the force on the trigger 32 must be kept slight in order to prevent wobbling of the weapon.

The play existing between the roll journal 36 and the window 35 permits of moving the trigger 32 in the anti-clockwise direction by the trigger finger without entraining the trigger insert 30 until the roll journal 36 comes to abut on the lower edge of the window 35. This movement play is called a "first pressure take-up". One can also speak of a "simulated pressure point" where the roll journal 36 comes to abut against the lower edge of the window 35.

A trigger safety catch lever 39 carrying a manual actuation tag 40 at its upper end is further mounted pivotably about a bearing bolt 38 in the lock case 14. This manual actuation tag 40 extends through a cover member or lid 41 closing the rearward end of the partially cylindrical rearward section of the lock case 14 and of the cylinder tube 12, which lid is provided with an opening 42 for this purpose. A trigger safety catch stop 44 is mounted pivotably about a pivot spindle 43 on the trigger safety catch lever 39. An operating lever spring 45 simultaneously initially stresses the trigger safety catch lever 39 in the direction towards the edge of the sheet metal tab 14*e* and the trigger safety catch stop 44 in the direction towards an abutment edge 46 of the trigger safety catch lever 39. In FIG. 1 the trigger safety catch stop 44 of the trigger safety catch lever 39 stands opposite to a counter-stop 47 of the trigger 32, so that the trigger 32 cannot be pivoted in the anti-clockwise direction, thus trigger action is blocked and the weapon is set at safety.

For the initiation of the shot firstly the safety catch must be released; for this purpose the trigger safety catch lever 39 must be pivoted in the anti-clockwise direction about the bearing bolt 38, so that the trigger safety catch stop 44 is shifted out of the path of the pivoting of the counter-stop 47 of the trigger 32 about the bearing bolt 33.

The trigger safety catch lever 39 is connected through a peg 48 with an index spring 49. When the trigger safety catch lever 39 is pivoted in the anti-clockwise direction, a depression 50 of the index spring 49 comes to lie on the diametrical pin 16, as represented in FIG. 3, so that the trigger safety catch lever 39 is held in the position according to FIG. 3 against the action of the operating lever spring 45.

At this point it should be remarked that the trigger safety catch lever 39 is arranged and movable with its manual actuation element 40 in the longitudinal central plane of the weapon, so that it can be operated equally well by right-handed and left-handed persons.

It should further be remarked that the trigger safety catch lever 39 and the index spring 49 can be detached with a few manual actions, namely simply by removal of the lid 41, knocking out of the bearing bolt 38 and subsequent withdrawal of the trigger safety catch lever 39 with the trigger safety catch stop 44 and the operating lever spring 45 and the index spring 49. If thereafter a safety catch is not desired, this can be removed from the construction unit 13 after assembly, or conversely can be installed in this unit.

Figure 3:
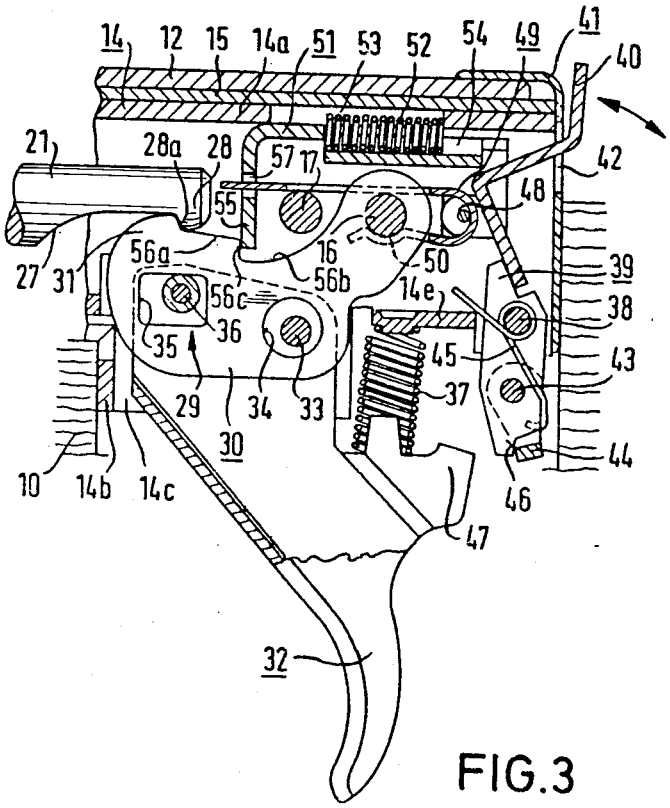
FIG. 3 represents a section corresponding to that in FIG. 1, the weapon again being cocked but the safety catch being released.
Figure 4:
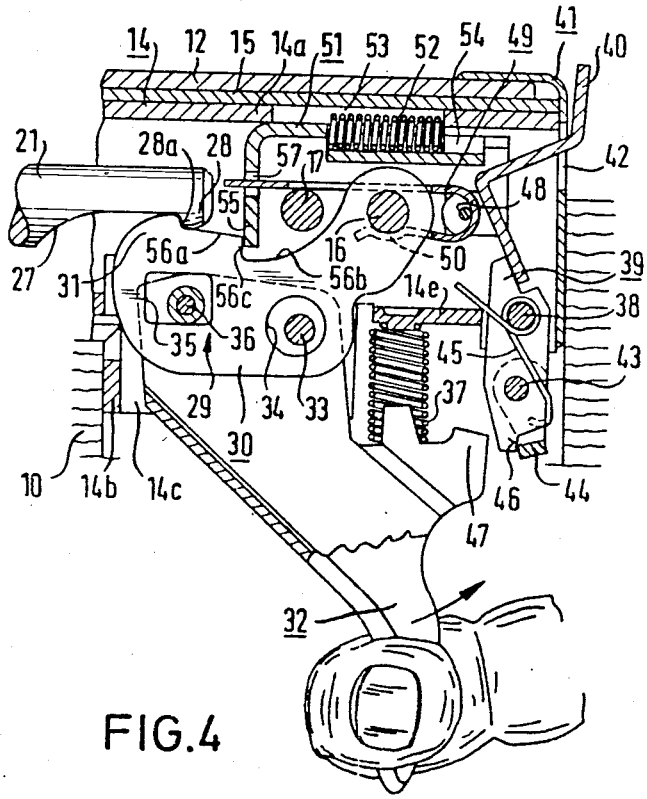
FIG. 4 represents a longitudinal section corresponding to that in FIG. 1, the weapon being again cocked and the safety catch released, but the trigger already having taken up first pressure under the action of a finger.

As soon as the trigger safety catch lever 39 has been put, as represented in FIG. 3, into the trigger release position, the trigger 32 can be pivoted according to FIG. 4 in the anti-clockwise direction, in which action the counter-stop 47 of the trigger 32 can move past the trigger safety catch stop 43 of the trigger safety catch lever 39. In FIG. 4 the condition is represented in which the trigger insert 30 is beginning to rotate in the anti-clockwise direction about the diametrical pin 16, so that the counter-hook element 31, overcoming the self-blocking existing until then, is beginning to unhook from the hook element 28.

Figure 5:
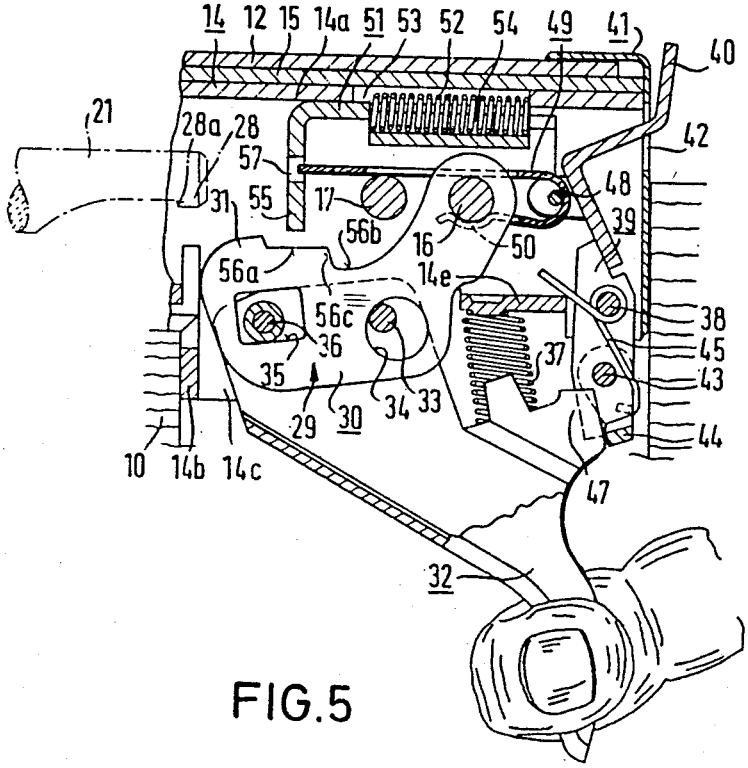
FIG. 5 shows a longitudinal section corresponding to that in FIG. 1, where the shot has just been projected and the trigger is still pulled back fully by the trigger finger.

In FIG. 5 the trigger insert 30 has been pivoted by the trigger 32 so far that the counter-hook element 31 has lifted away completely from the hook element 28 and the piston rod 21 has been pushed under the action of the piston rod spring 26 (FIG. 1) to the left, compressing the air in the above-mentioned compression chamber, whereupon the compressed air projects the shot through the barrel.

For the understanding of the further description of function now a particular constructional feature is to be discussed.

Figure 2:
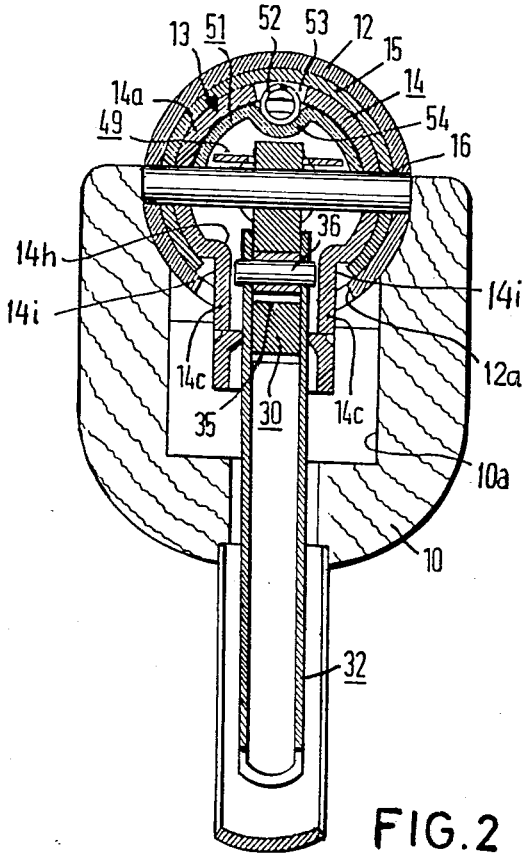
FIG. 2 represents a section along the line II—II in FIG. 1.

In the lock case 14 a blocking slider 51 is guided for displacement in the axial direction of the piston rod 21, namely due to the fact that, as visible from FIG. 2, the blocking slider 51 rests with cylindrically curved guide faces on the cylindrical lock case part 14 and on the other hand on the diametrical pins 16 and 17.

As may be seen from FIG. 2, a compression spring 52 is received for the one part by a slot 53 in the cylindrical lock case part 41*a* and on the other part by a crease 54 in the blocking slider 51. The blocking slider 51 is initially stressed to the left in FIG. 1 by the compression spring 52. A downwardly angled-off tag 55 of the blocking slider 51 is formed as a slideway sensor which co-operates with a slideway 56 on the upper edge of the trigger insert 30. The slideway 56 has an upper step 56*a* and a lower step 56*b*.

In FIG. 1 the slideway sensor 55 is held to the right against the action of the compression spring 52 by the shoulder 56*c* between the steps 56*a* and 56*b*. A window 57 allowing passage of the free end of the index spring 49 is arranged in the slideway sensor 55.

Figure 6:
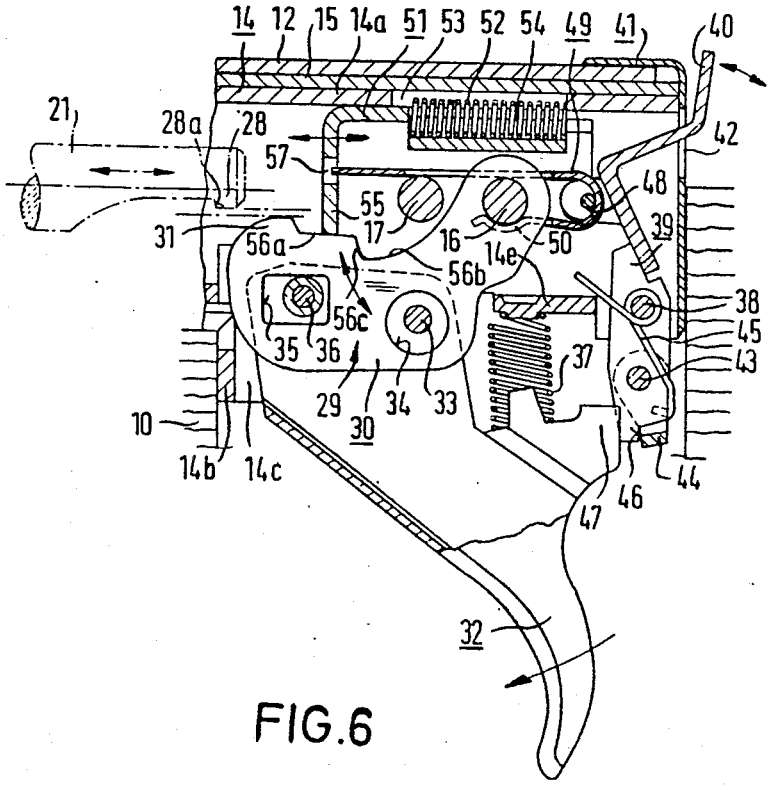
FIG. 6 shows a longitudinal section corresponding to that in FIG. 1 after the shot has taken place and the trigger has been released.

When, as represented in FIG. 5, the piston rod 21 has been released by the trigger 32 by means of the trigger insert 30, then the slideway sensor 55, as likewise visible from FIG. 5, has arrived over the slideway step 56*a*, so that on the subsequent release of the trigger 32, as represented in FIG. 6, the slideway sensor 55 initially prevents the pivoting of the trigger insert 30 up into the position as illustrated in FIG. 1, by action upon the slideway step 56*a*.

The condition as represented in FIG. 6 is that which is established after the shot has taken place and the trigger 32 has been released, before the weapon is cocked again.

When the weapon is cocked again, the piston rod 21 is shifted to the right against the action of the piston rod spring 26. The displacement of the piston rod to the right is effected for example by pivoting down of the barrel (not shown), through a cocking rod which articulatedly connects the barrel with the piston tube 22.

Now FIG. 6 shows that in the displacement of the piston rod 21 to the right in the course of the cocking operation the hook element 28 runs contactlessly over the counter-hook element 31. Only when the piston rod 21 strikes with its right end against the blocking slider 51 is the slide-way sensor 55 displaced with the blocking slider so far to the right, against the action of the compression spring 52, that the slideway sensor 55 can finally drop into the lower slideway step 56*b*, that is to say the trigger insert 30 can pivot in the clockwise direction under the action, communicated by the trigger, of the trigger return spring 37, so that the counter-hook element 31 comes into the hook engagement readiness position opposite to the hook element 28. When now the initiation of cocking, as by means of the tilting barrel, is ended, the piston spring 26 can relax somewhat again and the piston rod can return to the left until the hook element 28 comes to abut on the counter-hook element 31.

The length of the upper slideway step 56*a* thus determines the necessary past-cocking distance which is necessary so that the trigger insert 30 may be brought into hook engagement readiness at all.

It must be determined that due to the contactless passage of the hook element 28 over the counter-hook element 31, these elements, which are highly stressed by the great force of the piston initial-stressing spring 26, are subjected to protective treatment, which is of essential importance to the life of the weapon.

The necessary past-cocking distance, the occurrence of which was just derived from the presence of the slideway 56 and of the slideway sensor 55, is also of importance in as much as this past-cocking distance, in the cocking of the weapon, that is in the displacement of the piston rod 21 in FIG. 6 to the right, has the result that the piston rod 21 positively entrains the index spring 49 so far to the right that the trigger safety catch lever 39 is pivoted, by means of the index spring 49, again to the right into the trigger securing position according to FIG. 1. This signifies that in cocking the trigger safety catch lever 39 is positively brought every time into the trigger securing position according to FIG. 1. Once the weapon has been cocked and the trigger safety catch lever is in the trigger securing position according to FIG. 1, it is possible to pivot the trigger safety catch lever 39 into the trigger release position and back again into the trigger securing position as often as desired.

It is not possible to exclude the possibility of a marksman occasionally trying to cock the weapon while holding the trigger 32 fully pressed with the trigger finger, as represented in FIG. 5. If then the piston rod 21 arrives with its right end against the left end of the long leg of the index spring 49, the latter will seek to pivot the trigger safety catch lever 39 in the clockwise direction. If now the trigger safety catch stop 44 were fitted rigidly on the trigger safety catch lever 39, the pivoting of the trigger safety catch lever 39 would be blocked and either the cocking would be prevented or, if excessive force is used, destruction would occur. Since however now the trigger safety catch stop 44 can yield about the piston axis 43, against the action of the operating lever spring 45, pivoting of the trigger safety catch lever 39 around into the trigger securing position is possible, and then the trigger safety catch stop 44 pivots in again over the counter-stop 47 of the trigger 32 when the trigger 32 is released. Then the condition according to FIG. 1 is again reached.

The recoil necessarily occurring in shooting is introduced through the lock case 14 into the stock 10, namely through the wall extensions 14*b* and 14*d*, possible also the lid 41. Loading of the securing screws by the recoil is therefore largely precluded. A simulated pressure point is achieved by the play of the roll journal 36 in relation to the window 35.

All the functional parts, especially of the hook-engagement system 29 and of the safety catch system, which are difficult to fit and to handle are integrated into one single construction unit.

The diameterical pins 16 and 17 take over a multiple function: Firstly they constitute the connection of the lock case 14 with the cylinder tube 12, secondly they take over the guidance of the blocking slider 51 in the lock case 14. Thirdly the diametrical pin 16 takes over the bearing function for the trigger insert 30; fourthly the diametrical pin 16 takes over a snap engagement function in combination with the index spring 49. Fifthly the diametrical pin 16 takes over the function of a distance-limiting stop for the blocking slider 51, which has an abutment edge 58 opposite to the diametrical pin 16.

The installation of the diametrical pin 17 in the fitting of the construction unit in the cylinder tube is entirely uncritical. However the installation of the diametrical pin 16 can also be effected easily in that in the fitting together of the construction unit 13 an assembly pin is provided in place of the diametrical pin 16, and then in the installation of the construction unit into the cylinder tube in an appropriate device the assembly pin is replaced by the diametrical pin 16 which, while it is being driven in, expels the assembly pin before it.

Figure 8:
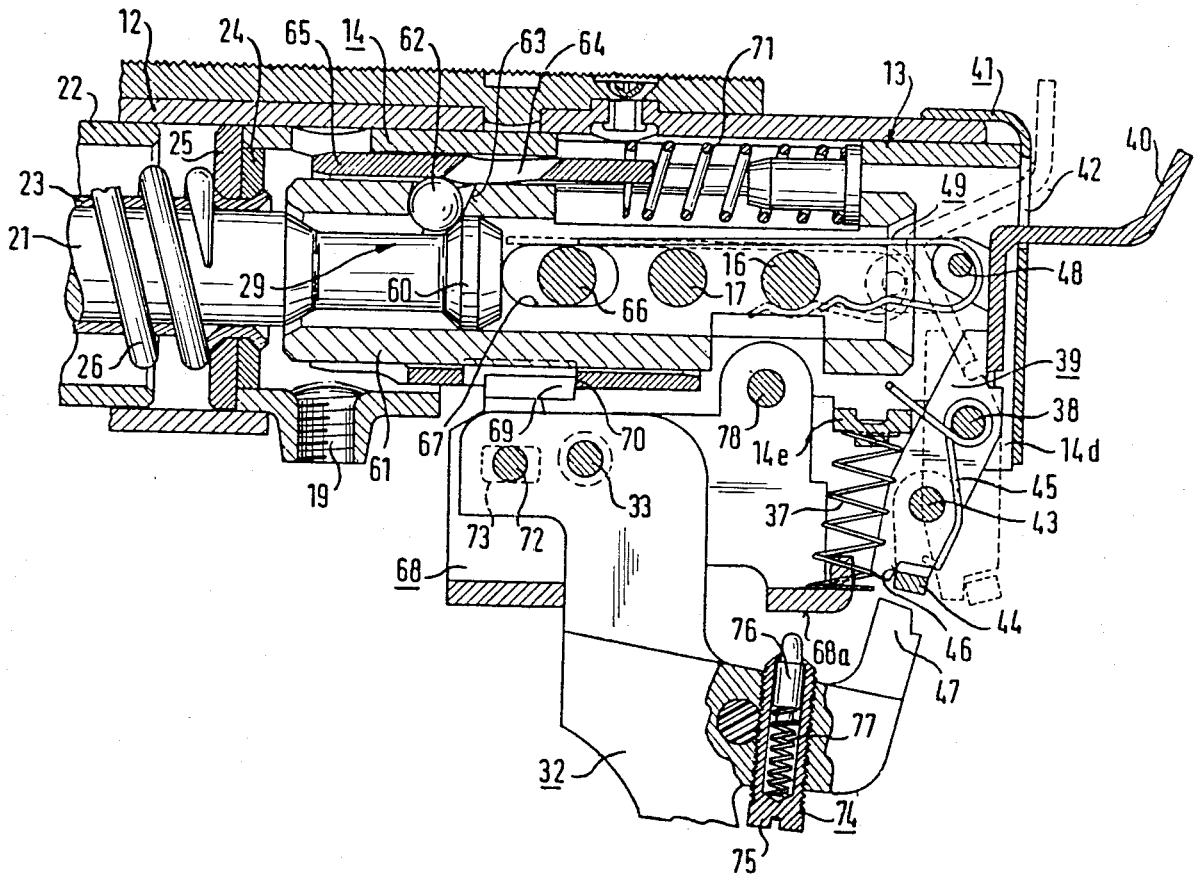
FIG. 8 shows a longitudinal section through another form of embodiment of a construction unit.

In FIG. 8 analogous parts are provided with the same reference numerals as in FIGS. 1 to 7.

The counter-hook-engagement system is modified in comparison with the form of embodiment according to FIGS. 1 to 7.

The piston rod 21 is made at its right end with a rotation-symmetrical hook 60 which drives into a retaining sleeve 61 when the weapon is cocked. The rotation-symmetrical hook 60 then drives rolling bodies 62 through rolling body reception sockets 63 radially outwards into control slots 64 of a control sleeve 65.

In cocking, the control sleeve 65 is initially situated so far to the left that the control slots 64 are in coincidence with the rolling body reception sockets 63. As soon as the rotation-symmetrical hook body 60 has passed the rolling bodies 62, these can again approach, radially inwards, the narrowed shank of the piston rod 21, so that the control sleeve 65 can now be entrained, by means of a diametrical pin 66 passing through a slot 67 of the retaining sleeve, by the piston rod 21 advancing to the right. As soon as the control sleeve 65 has reached the position as shown in FIG. 8, a lock holder 68 drops with a lock holder nose 69 behind a retaining edge 70 of the control sleeve 65, so that the control sleeve is held back, against the action of the compression spring 71, in a position in which, as shown by FIG. 8, the control slots 64 are out of alignment with the rolling body reception sockets 63, thus the rolling bodies 62 effect a hook engagement of the retaining sleeve 61 with the rotation-symmetrical hook head 60.

The trigger 32 is mounted on the lock case by a bearing bolt 33 and engages with an engaging bolt 72 in a slot 73 of the lock holder 68.

At the beginning of the shooting movement of the trigger 32 about the bearing bolt 33 the trigger 32, through the engaging bolt 72 and the slot 73, takes the retaining nose 69 with its downwards initially only slowly, that is with small step-up, since the distance of the engaging bolt 72 from the bearing bolt 33 is very short.

However now a pressure point cartridge 74 is also fitted in addition on the trigger 32. This cartridge comprises an adjustable cartridge case 75 and a pressure bolt 76 displaceably mounted therein which is subject to the action of a compression spring 77. The pressure point spring 77 is set relatively hard. As soon as the pressure point bolt 76 comes against the abutment face **68*a* of the lock holder 68, the lock holder 68 is entrained with increased distance step-up, so that the slightest further movement of the trigger 32 suffices to bring the lock holder 68 with its retaining nose 69 out of the engagement with the retaining edge 70 of the control sleeve 65. An increased force corresponds to the greater distance step-up, and this increased force, which is necessary in order to rotate the trigger 32 further about the pivot bolt 33 and the lock holder 68 about its bearing bolt 78**, represents the pressure point.

The trigger safety catch system works exactly as in the form of embodiment described above.

In the form of embodiment according to FIG. 8, since the retaining hook engagement is taken over by the rolling bodies 62, the abutment force between the lock holder nose 69 and the retaining edge 70 is slight, so that the trigger can be set finely sensitively.

It should also be pointed out that the arrangement according to FIGS. 1 to 7 and the arrangement according to FIG. 8 can be used according to choice in one and the same weapon.

Figure 9:
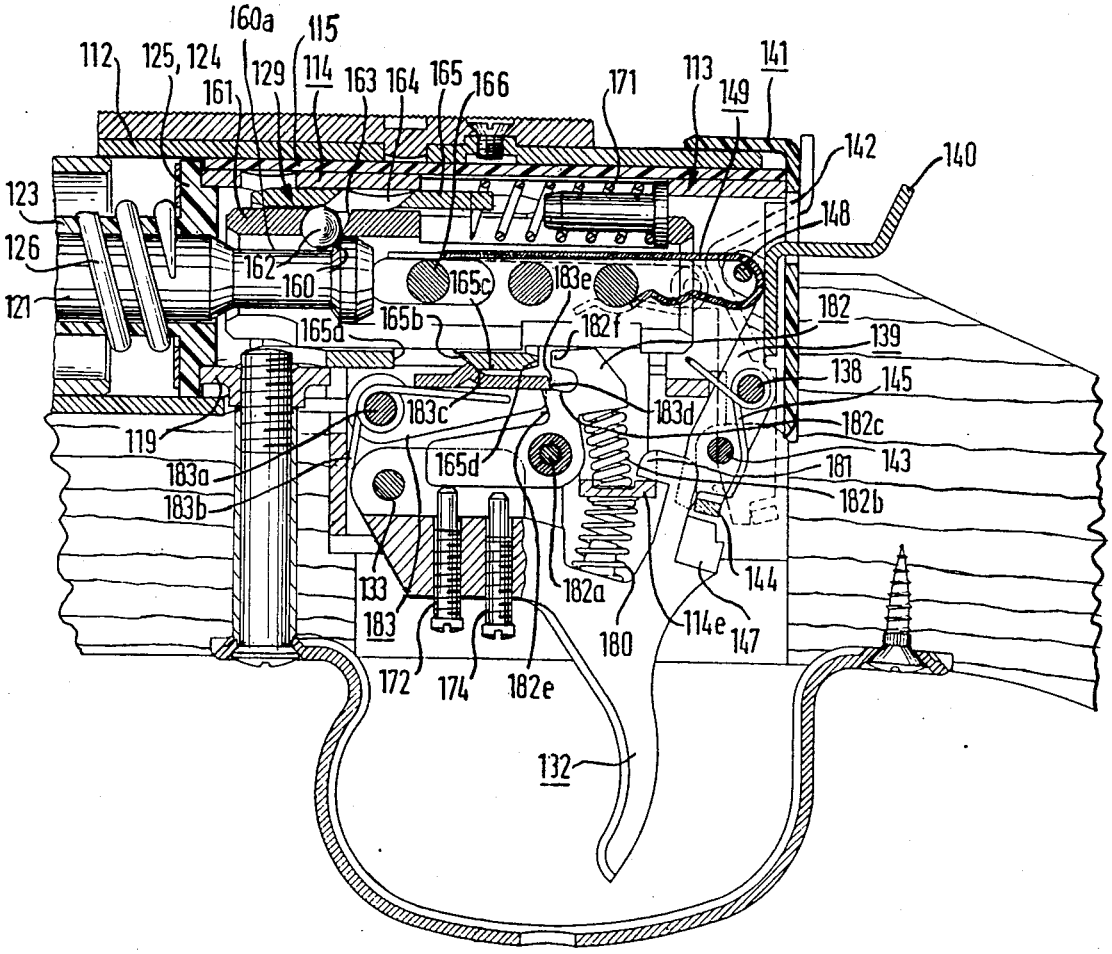
FIG. 9 shows a preferred modification of FIG. 8.

In FIG. 9 there is represented a modification of FIG. 8. Analogous parts are designated with the same reference numerals as in FIGS. 1 to 8, each increased by the number 100.

The following differences from FIG. 8 are to be set forth:

The trigger 132 is initially stressed by a spring 180 into a rest position, which is determined by supporting of a support hook 181 on the tab (fixed stop) **114*e***.

Two co-operating hooks 182, 183 are mounted pivotably in the lock case 114 about associated pivot bolts **182*a* and 183*a* respectively, and a bush is provided on the pivot bolt 182*a* for better bearing mounting. The hook 182, since it co-operates directly with the trigger 132, will be designated as the first or trigger hook 182, while the other hook 183 is designated as the second or control-sleeve hook 183, because it co-operates directly with the control sleeve 165. THe trigger hook 182 is subject to the action of a spring 182*b* which bears on the tab 114*e*, while the control-sleeve hook 183 is subject to the action of an operating lever spring 183*b***. Each hook is loaded by the respective spring in the counter-clockwise direction.

In FIG. 9 the weapon is cocked. The piston rod 121 is held fast in its cocked position by the rolling bodies 162 against the action of the helical compression spring 126, the rolling bodies 162 being pressed inwards in the rolling body reception sockets 163 of the retaining sleeve 161 by the control sleeve 165 so far that the rolling bodies 162 secure the hook body 160 against a movement to the left in FIG. 9. The head portion or hook body 160 is fixed to the rearward end of the piston rod 121 by a neck section **160*a*. The retaining sleeve 161 is coaxial with the cylinder tube 112 and is fixed axially with respect to the cylinder tube. The control sleeve 165 surrounds the retaining sleeve and is axially slidable therein. The control sleeve 165 has an axially extending full or imperforate section and an axially extending perforate section containing a plurality of control slots 164. The full section of the control sleeve 165 covers the reception sockets 163 in the retaining sleeve 161 in the retaining position where the rolling bodies 162 are held in the neck section 160***a*. Further, the control sleeve 165 is secured in the position as shown in FIG. 9, in which it secures the rolling bodies 162 against radial outward deviation, against deviation to the left under the action of the helical compression spring 171 by the fact that a blocking nose 183*c* rests with its right, inclined flank against a correspondingly inclined flank 165*b* at the edge of a piercing 165*a* of the control sleeve 165. The spring biases the control sleeve toward a non-retaining position in which the control slots 164 are in substantial radial alignment with the reception sockets 163. The sleeve hook 183 is secured in this blocking position in that a support face 182*c* of the trigger hook 182 rests on a counter-support face 183*d* of the control-sleeve hook 183. The sleeve hook 183 is rockable about an an axis 183*a* fixed with respect to the cylinder tube. The sleeve hook 183 has a wedge-shaped retaining flank 183*c* engageable with a counter-retaining flank 165*b* on the control sleeve 165. The trigger hook 182 on the other hand is secured in this support position by the spring 182*b*, and this readily suffices because the support force generates practically no moment about the pivot bolt 182*a*. The trigger hook is rockable about a trigger hook axis defined by pivot bolt 182*a* stationary relative to the cylinder tube 112, and parallel with the sleeve hook axis defined by pivot bolt 183*a*. The trigger hook 182 has a lever arm.

If, starting from the cocked position of the weapon according to FIG. 9, the trigger 132 is pressed, the trigger 132 rotates in the anti-clockwise direction about the pivot bolt 133 which is stationary relative to the cylinder tube 112 and the trigger hook 182 is pivoted, by means of the first pressure stop 172 in contact with the trigger hook lever arm, in the clockwise direction about the pivot bolt 182*a* against the action of the helical compression spring 182*b*. This pivoting movement of the trigger hook 182 in the clockwise direction is greatly stepped down by the fact that the first pressure stop 172 lies quite close to the pivot bolt 133. Accordingly the support face 182*c* slides only quite slowly over the counter-support face 183*d*. Only when the pressure point stop 174 has come to abut against the trigger hook 182 and the trigger 132 is pressed further does an accelerated movement of the support face 182*c* in relation to the counter-support face 183*d* occur with the increase of resistance (pressure point), so that the support face 182*c* and the counter-support face 183*d* depart from one another. The remaining overlap between the support face 182*c* and the counter-support face 183*d*, which is still to be travelled when the pressure point stop 174 has once come against the trigger hook 182 is responsible for the moment of entry and the fine sensitivity of the pressure point. The shorter is this remaining overlap, the later does the pressure point come, that is the more finely sensitive is it. The stop 172 is located at a longer distance from the trigger hook rocking axis 182*a* than the other stop 174. The fine sensitivity can be adjusted by adjustment of the two stops, the first pressure stop 172 and the pressure point stop 174. A first connection line connects the trigger hook rocking axis 182*a* and the support face 182*c*. A second connection line substantially perpendicular to the first connection line connects the sleeve hook rocking axis 183*a* and the counter-support face 183*d* of the sleeve hook 183.

As soon as the counter-support face 183*d* is liberated from the support face 182*c*, the sleeve hook 183 can be pivoted by the control sleeve 165, by means of the oblique flanks 183*c* and 165*b*, against the action of the operating lever spring 183*b* in the clockwise direction about the pivot bolt 183*a*, so that the nose 183*c* liberates the flank 165*b* of the piercing 165*a* and accordingly the control sleeve 165 can spring to the left under the action of the helical compression spring 171. The flank 183*c* of the sleeve hook 183 has a smaller distance from the sleeve hook rocking axis 183*a* than the trigger hook support face 182*c*. Then the control slots 164 come into the region of the rolling body reception sockets 163, so that the rolling bodies 162, for example three at 120° intervals, can move radially outwards and actually are also pressed outwards by the hook body, the piston rod 121 then following to the left with the piston (not shown) under the pressure of the cocked piston spring 126, whereby the shot is projected in the manner as described above.

When the control sleeve 165 moves to the left under the action of the helical compression spring 171, the nose 183*c* places itself in engagement with a face 165*c* of the control sleeve 165 and the trigger hook 182, after releasing the trigger 132, places itself under the action of the spring 182*b* with the face 182*e* in frictional engagement on the end edge 183*e*.

When after the shot has taken place, the piston rod 121 is pushed back to the right in renewed cocking, firstly the hook body 160 runs over the rolling bodies 162, which yield radially outwards into the control slots 164, and then comes to abut on the past-cocking path against the diametrical pin 166. On continuation of the past-cocking travel of the piston rod 121 the diametrical pin 166 is entrained to the right and with it the control sleeve 165, which is connected with it for common axial movement. The movement of the control sleeve 165 to the right takes place against the resistance of the helical compression spring 171. Then an end edge 165*d* of the control sleeve 165 comes into engagement with a stop face 182*f* of the trigger hook 182, so that the latter is pivoted in the clockwise direction about the pivot bolt 182*a* against the action of the helical compression spring 182*b*. This pivoting of the trigger hook 182 in the clockwise direction during the past-cocking travel of the control sleeve has the consequence that the face 182*e* disengages itself from the right end edge 183*e* of the sleeve hook 183 and then this sleeve hook 182 can pivot under the action of its operating lever spring 183*b* in the anti-clockwise direction again and its blocking nose 183*c* can enter the opening 165*a*. The control sleeve 165 goes back to the left as soon as, after the ending of the cocking operation, the hook body 160 is allowed to go back to the left by the past-cocking distance. Before the flank 165*b* comes to strike upon the blocking nose 183*c* the support face 182*c* engages under the action of the helical compression spring 182*b* under the counter-support face 183*d*. Thus the condition of the cocked weapon as shown in FIG. 9 is restored.

It is to be noted that the support face 182*c* and the counter-support face 183*d* lie vertically above the joint bolt 182*a*. This is essential so that the support face 182*c* and the counter-support face 183*d* can slide past one another in shooting, without the occurrence of a pivoting movement of the sleeve hook 183. This is of essential importance for an easy and thus finely sensitive trigger action.

Figure 10:
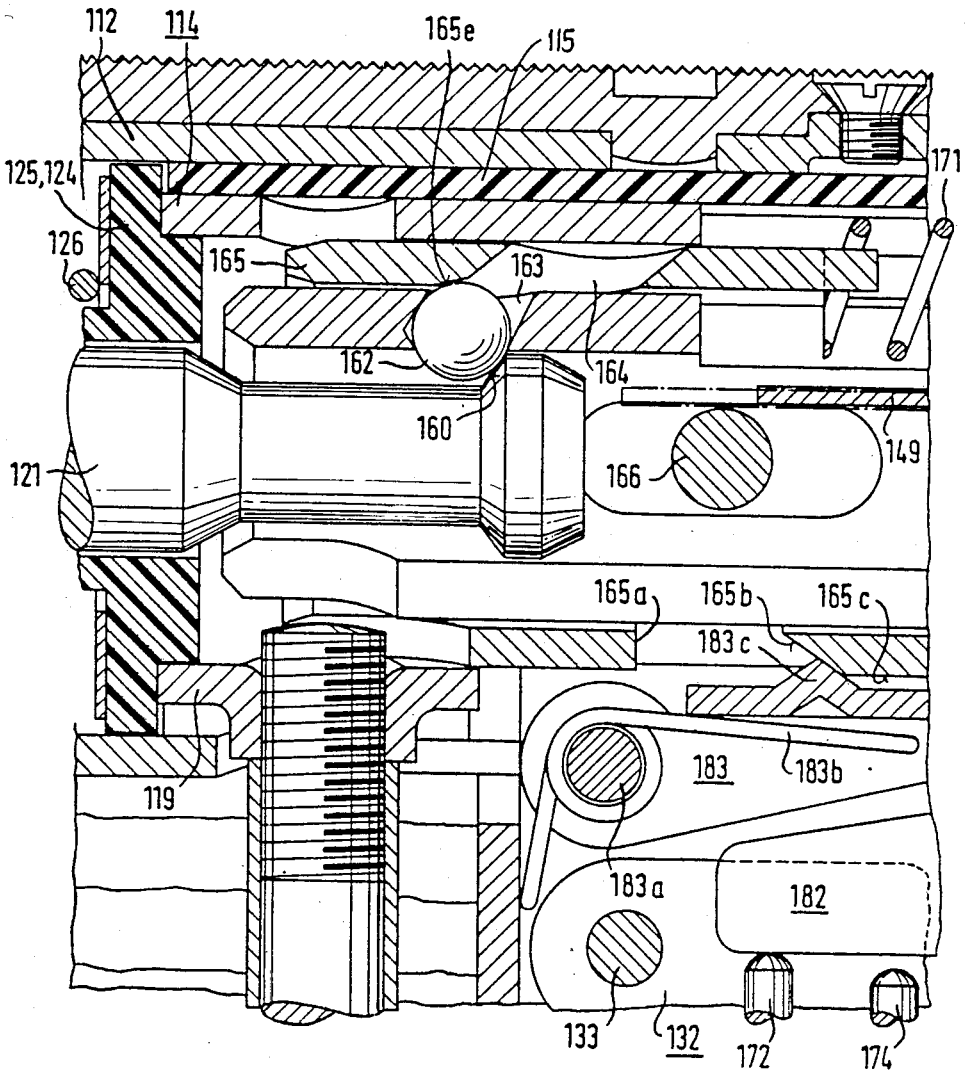
FIG. 10 shows an enlarged representation of a detail from FIG. 9.

For the understanding of the significance of the form of embodiment according to FIG. 9 reference is now made to FIG. 10: there it is seen that under spring stress the hook body 160, by way of the rolling bodies 162 and a slightly inclined oblique face 165*e* of the control sleeve 165, generates a force component upon the control sleeve 165 which superimposes itself upon the force of the helical compression spring 171. Since the stress force due to the spring 126 acting upon the piston rod 121 is very great, a relatively great force also acts upon the control sleeve 165 seeking to draw this to the left when the weapon is cocked. This force is taken up by the co-operation of the flanks 183*c* and 165*b*, further by the co-operation of the support face 182*c* and the counter-support face 183*d*, which co-operation is ensured by the spring 182*b*.

The resistance which the trigger 132 opposes to the finger acting upon it depends substantially upon the sliding resistance generated by the faces abutting on one another, support face 182*c* and counter-support face 183*d*. This resistance force is small, firstly because the location of the support face 182*c* and of the counter-support face 183*d* is substantially more remote (about twice as far) from the pivot point 183*a* than the nose 183*c*, so that the support force between the support face 182*c* and the counter-support face 183*d* is small. Secondly in the pivoting of the hook 182 the hook 183 does not need to be moved, on account of the special position of the support face 182*c* and of the counter-support face 183*d* in relation to the pivot bolt 182*a*. Thirdly there is the fact that the first pressure stop 172 acts at a very short distance from the pivot bolt 133. All this causes an easy pull to the pressure point. However even after the pressure point is reached, when the pressure point stop 174 acts on the hook 182, the resistance of the trigger 132 opposing the finger is as slight as desired. For this purpose it is only necessary to select the transmission ratio of the hook 183 appropriately, that is to enlarge the distance of the support face 182*c* and the counter-support face 183*d* from the pivot bolt 183*a* compared with the distance of the nose 183*c* from the pivot point 183*a*.

The invention permits of providing an easy-moving and finely sensitive, regulable trigger pull, necessary for exact aiming, even in compressed-air weapon of high shot energy, that is with strong cocking spring 126.

It is also to be noted that in all manipulations of the weapon the trigger 132 remains at rest, with the exception of the trigger-pulling action in which the finger of the marksman acts upon the trigger.

I claim:

1. A compressed-air weapon comprising a stock (10), a cylinder tube (12) having an axis arranged on an upper face of said stock (10), a piston arranged displaceably in said cylinder tube (12) with a piston rod (21) extending rearwards from said piston, i.e. contrarily of the barrel direction, a piston spring (26) surrounding the piston rod (21) acting upon the piston and supported in axial direction on an abutment (25) fast with respect to the stock (10), piston retaining means (28, 29) formed with a hook element (28) in a rearward end section of the piston rod (21) remote from the barrel end thereof and a counter-hook engagement system (29) triggerable by a trigger (32) against the action of a trigger return spring (37), said trigger (32) being partially accommodated within a recess (10*a*) of the stock (10), which recess (10*a*) traverses the stock (10) in a substantially vertical direction perpendicular with respect to said axis, said cylinder tube (12) having a rearward end adjacent the rearward end of said recess (10*a*) and further having a slot (12*a*) in a peripheral zone adjacent said stock (10), said slot (12*a*) being adjacent the upper exit of said recess (10*a*), said counter-hook engagement system (29), said trigger (32) and said trigger return spring (37) being premounted within a sheet metal-made lock case (14), said lock case (14) being made of a continuous sheet metal cut-out shape and comprising a cylindrical lock case part (14*a*) with a cylindrically closed forward section and a partially cylindrical rearward section coaxial with said forward section, said partially cylindrical rearward section having an opening (14*h*) adjacent said slot (12*a*) of said cylinder tube (12), said opening (14*h*) having longitudinal edges (14*i*) substantially parallel to said axis, coherent wall attachments (14*c*) of said partially cylindrical rearward section extending downwardly from said longitudinal edges (14*i*) and defining a lower lock case part (14*c*, 14*b*), said lower lock case part (14*c*, 14*b*) passing through said slot (12*a*) and being received by said recess (10*a*), said lower lock case part (14*c*, 14*b*) engaging at least one axially directed end face (10*b*, 10*c*) of said recess (10*a*), said cylindrical lock case part (14*a*) being received over substantially its total length by said cylinder tube (12) such that a rearward end of said partially cylindrical rearward section is adjacent the rearward end of said cylinder tube (12) and said cylindrically closed forward section extends forwards beyond said recess (10*a*), a fastening screw (18) extending through said stock (10) in substantially vertical direction substantially perpendicular to said axis and engaging a screw hole within said cylindrically closed forward section, a cover member (41) separate from said cylinder tube (12) and said lock case (14) covering the rearward ends of said cylinder tube (12) and said partially cylindrical rearward section, said abutment (25) being axially supported by a forward end of said cylindrically closed forward section.

2. Compressed-air weapon according to claim 1, characterised in said lock case comprises a prefabricated construction unit (13) at least partially enclosing its components.

3. Compressed-air weapon according to claim 1, characterised in that an assembly unit (12, 13) consisting of said cylinder tube (12) and said prefabricated construction unit (13) is secured on the stock by said fastening screw (18), which passes through the stock (10) and penetrates from beneath into the lock case (14).

4. Compressed-air weapon according to claim 2, characterised in that said abutment (25) for the piston spring (26) is supported at the barrel end of the lock case (14).

5. Compressed-air weapon according to claim 1, characterized in that the cylindrical lock case part (14*a*) has a closure joint and is closed at the closure joint by a dovetail-type tongue-and-groove pairing (20).

6. Compressed-air weapon according to claim 1, characterised in that the cylindrical lock case part (14*a*) is secured in the cylinder tube (12) by at least one diametrical securing pin (16, 17).

7. Compressed-air weapon according to claim 6, including a trigger safety catch system (39, 49) and the at least one diametrical securing pin is at the same time a functional part of at least one of the counter-hook-engagement system (29) and of the trigger safety catch system (39, 49).

8. Compressed-air weapon according to claim 1, characterised in that the lock case (14) is covered at its end remote from the barrel end thereof by a detachable closure lid (41) which abuts on the stock.

9. Compressed-air weapon, according to claim 1, characterised in that a trigger safety catch system (39, 49) is formed as a removable accessory.

10. Compressed-air weapon, according to claim 9, characterised in that the trigger safety catch system (39, 49) is transferrable positively into a trigger safety position by the piston rod (21) being drawn back in cocking beyond the cocked position into a past-cocked position and after the return of the piston rod from the past-cocked into the cocked position it is transferrable by hand into a trigger release position and back again into the trigger safety position.

11. Compressed-air weapon according to claim 10, characterised by the counter-hook-engagement system (29) being configured ready for hook engagement only when the past-cocked position is reached.

12. Compressed-air weapon according to claim 11, characterised in that the trigger safety-catch system (39, 49) comprises a trigger securing element (39) entrainable by the piston rod (21), on its way into the past-cocked position, into the trigger-securing position, remaining in this trigger-securing position in the return of the piston rod, and transferrable by hand into the trigger release position, with a trigger-securing stop (44) which in the trigger-securing position stands opposite to a counter-stop (47) of the trigger (32), blocking the trigger movement, and in the trigger-release position liberates the counter-stop (47) of the trigger (32) for the trigger movement thereof.

13. Compressed-air weapon according to claim 12, characterised in that the trigger securing element (39) is held in at least one of the trigger-securing position and the trigger-release position by elastic retaining means (49, 45).

14. Compressed-air weapon according to claim 12, characterised in that the trigger-securing stop (44) is arranged movably on the trigger securing element (39) and is initially stressed into a stop position in relation to the trigger securing element (39) in such a way that on transference of the trigger securing element into the trigger-securing position by the piston rod (21) the trigger securing stop (44) can be deflected when it strikes upon the trigger (32) held in the shooting position.

15. Compressed-air weapon especially according to claim 14, characterised in that the trigger safety catch system (39, 49) is provided with a manual actuation element (40) which lies in the plane of longitudinal symmetry of the weapon and is displaceable in this plane.

16. Compressed-air weapon according to claim 9, characterised in that the trigger safety-catch system (39, 49) comprises a manual actuation element (40) which is conducted through an opening (42) of a detachable closure lid (41) of the lock case (14) at the end thereof remote from the barrel end thereof, and in the case of absence of the trigger safety catch system (39, 49) this closure lid (41) can be replaced by another without opening.

17. Compressed-air weapon according to claim 1, characterised in that the lock case (14) is adaptable to at least one of different cylinder tubes (12) and stocks (10) by at least one liner part (15).

18. Compressed-air weapon according to claim 15, characterised in that the liner part (15) accommodate the cylindrical lock case part (14*a*) and in turn is fitted into the cylinder tube.

19. Compressed-air weapon especially according to claim 1, characterised in that the counter-hook-engagement system (29) comprises a trigger insert (30) which is pivotable about a horizontal pivot spindle (16) lying transversely of the axis of the piston rod between a piston rod retention position and a piston rod release position and comprises a counter-hook element (31) which, according to the position of the trigger inert (30) selectively one of engages and does not engage in the hook element (28) and in that an entraining device (35, 36) is provided between the trigger (32) and the trigger insert (30).

20. Compressed-air weapon according to claim 19, characterised in that the entraining device (35, 36) is affected by play between the trigger and trigger insert, forming a simulated pressure point.

21. Compressed-air weapon according to claim 19, characterised in that the pivot spindle (16) of the trigger insert (30) approximately intersects the axis of the piston rod (14), a hook-engagement face (28*a*) of the hook element (31) when the hook element is engaged by the counter-hook element lies within the outline of the piston rod (21) and is arranged approximately tangentially to the pivot spindle (16) of the trigger insert, the pivot axis (33) of the trigger (32) lies, in the axial direction of the piston rod (21), between the counter-hook element (31) and the pivot spindle (16) of the trigger insert (30), but below the axis of the piston rod (21), and in that the entraining device (35, 36) lies substantially vertically below the hook-engagement face (28*a*) of the counter-hook element (28).

22. Compressed-air weapon according to claim 19, characterised in that the trigger insert (30) abuts with a slideway (56) under the spring pressure of the trigger return spring (37) on a slideway-sensing edge (55) of a blocking slider (51) which is displaceable in the axial direction of the piston rod (21) by the piston rod (21) moving back in cocking, against the action of a blocking slider initial-stressing spring (52), the slideway (56) having such a form (56*a*, 56*b*, 56*c*) that the counter-hook element (31) enters a hook engagement readiness position only after the piston rod (21) has entered a past-cocked position.

23. Compressed-air weapon according to claim 22, characterised in that the blocking slider (51) possesses a sliding surface adapted to the internal circumferential surface of the cylindrical lock case part (14*a*) and is guided by this internal circumferential surface for the one part and by the diameterical pins (16, 17) of the cylindrical lock case part (14*a*) for the other part, and in that the blocking slider initial-stressing spring (52) is accommodated and supported in a crease (54) of the blocking slider (51) and an aperture (53) of the cylindrical lock case part (14*a*).

24. Compressed-air weapon according to claim 19, characterised in that the entraining device (35, 36) is formed by a slot (35) and a roll body (36) engaging in this slot (35).

25. A compressed-air weapon comprising a cylinder tube (112) having an axis, a piston arranged displaceably in said cylinder tube (112) with a piston rod (121) extending rearwards from said piston, i.e. contrarily of the barrel direction, a piston spring (126) surrounding the piston rod (121) acting upon the piston and supported in axial direction on an abutment (125) fast with respect to the cylinder tube (112), piston retaining means (129) formed with a hook element (160) in a rearward end section of the piston rod (121) remote from the barrel end thereof and a counter-hook engagement system (129) triggerable by a trigger (132) against the action of a trigger return spring (180), said hook element (160) being a head portion fixed to the rearward end of said piston rod (121) by a neck section (160*a*), said counter-hook engagement system (129) comprising a retaining sleeve (161) coaxial with respect to said cylinder tube (112) and axially fixed with respect to said cylinder tube (112), and further comprising a control sleeve (165) surrounding said retaining sleeve (161) and being axially slidable thereon, said retaining sleeve (161) comprising a plurality of reception sockets (163) distributed about the periphery of said retaining sleeve (161) and receiving a corresponding plurality of rolling bodies (162), said control sleeve (165) having a full section and a perforated section, said perforated section being provided with a corresponding plurality of control slots (164), said full section of said control sleeve (129) substantially covering said reception sockets (163) in a retaining position of said control sleeve (165) such as to hold said rolling bodies (162) in proximity to said neck section (160*a*) and in axial engagement with said head portion (160), said control sleeve (165) being biased by a control sleeve biasing spring (171) towards a non-retaining position in which said control slots (164) are in substantial radial alignment with respective ones of said reception sockets (163), so that said rolling bodies (162) can move radially outwards from said sockets (163) into said control slots (164) and disengage thereby from said head portion (160), said control sleeve (165) being retainable in said retaining position by a sleeve hook (183) rockable about a sleeve hook axis (182*a*) fixed with respect to said cylinder tube (112), said sleeve hook (183) having a wedge-shaped retaining flank (183*c*) engageable with a counter-retaining flank (165*b*) of said control sleeve (165) in a sleeve retaining position of said sleeve hook (183), said sleeve hook (183) being lockable in said sleeve retaining position by a trigger hook (182), said trigger hook (182) being rockable about a trigger hook rocking axis (182*a*) stationary with respect to said cylinder tube (112) and parallel to said sleeve hook rocking axis (183*a*), said trigger hook (182) having a support face (182*c*) engageable with a counter-support face (183*d*) of said sleeve hook (183), a first connection line connecting said trigger hook rocking axis (182*a*) and said support face (182*c*) being substantially perpendicular to a second connection line connecting said sleeve hook rocking axis (183*a*) and said counter-support face (183*d*) of said sleeve hook (183), said trigger hook (182) having a lever arm fixed thereto, said trigger (132) being rockably mounted about a trigger rocking axis (133), said trigger rocking axis (133) being stationary with respect to said cylinder tube (112), said trigger (132) being provided with at least one pressure stop (172, 174) acting onto said lever arm of said trigger hook (182).

26. A compressed-air weapon as set forth in claim 25, said retaining flank (183*c*) of said sleeve hook (183) having a smaller distance from said sleeve hook rocking axis (183*a*) than said trigger hook support face (182*c*).

27. A compressed air weapon as set forth in claim 25, said trigger (132) being provided with two pressure stops (172, 174), a first pressure stop (172) engaging said lever arm of said trigger hook (182) at a location having a larger distance from said trigger hook rocking axis (182*a*) and a second pressure stop (174) acting on said lever arm of said sleeve hook (182) at a location having a smaller distance from said trigger hook rocking axis (182*a*).

28. A compressed-air weapon as set forth in claim 25, said sleeve hook (183) being biased towards a sleeve retaining position by a sleeve hook spring (183*b*).

29. A compressed-air weapon as set forth in claim 25, said trigger hook (182) being biased towards a sleeve hook locking position by a trigger hook spring (182*b*).

30. A compressed-air weapon as set forth in claim 25, further comprising a trigger securing element (139) cooperating with said trigger (132), said trigger securing element (139) being connected with an index spring (149), said index spring (149) having an end engageable by said piston rod (121), said piston rod (121) being movable through a cocked position into a past-cocked position in order to bring said counter-hook engagement system (129) into a cocked condition, said piston rod (121) entraining said index spring (149) in response to movement into said past-cocked position, said entraining of said index spring (149) transferring said trigger securing element from a trigger release position to a trigger securing position, said trigger securing element (139) remaining in said trigger securing position on return of said piston rod (121) into said cocked position.

* * * * *